US009612606B2

(12) United States Patent
Horng et al.

(10) Patent No.: US 9,612,606 B2
(45) Date of Patent: Apr. 4, 2017

(54) BANDGAP REFERENCE CIRCUIT

(75) Inventors: Jaw-Juinn Horng, Hsinchu (TW); Kuo-Feng Yu, Zhudong Township (TW); Chung-Hui Chen, Hsinchu (TW)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 1240 days.

(21) Appl. No.: 13/472,063

(22) Filed: May 15, 2012

(65) Prior Publication Data

US 2013/0307516 A1 Nov. 21, 2013

(51) Int. Cl.
*G05F 3/30* (2006.01)

(52) U.S. Cl.
CPC ..... *G05F 3/30* (2013.01)

(58) Field of Classification Search
CPC . G05F 3/02; G05F 3/222; G05F 3/225; G05F 3/26; G05F 3/30
USPC ..... 323/304, 311–316
See application file for complete search history.

(56) References Cited

U.S. PATENT DOCUMENTS 7,514,987 B2 * 4/2009 Lin ..... 327/539
7,852,061 B2 * 12/2010 Liu et al. ..... 323/313
7,863,882 B2 * 1/2011 Harvey ..... G05F 3/30 323/273
7,880,459 B2 * 2/2011 Harvey ..... G05F 3/30 323/313
8,110,835 B2 * 2/2012 Kumar ..... H05B 33/0818 257/79
8,330,445 B2 * 12/2012 Herbst ..... G05F 3/30 323/312
8,446,140 B2 * 5/2013 Harvey ..... G05F 3/30 323/311
2007/0296392 A1 * 12/2007 Chen et al. ..... 323/313
2009/0039949 A1 * 2/2009 Pietrobon ..... G05F 3/30 327/539
2009/0058391 A1 * 3/2009 Rokos ..... G05F 3/30 323/313

(Continued)

FOREIGN PATENT DOCUMENTS

SE WO 2012150161 A1 * 11/2012 ..... H01L 29/1608

OTHER PUBLICATIONS

Phili K. T. Mok; et al., "Design Considerations of Recent Advanced Lowe-Voltage Low-Temperature-Coefficient CMOS Bandgap Voltage Reference", IEEE 2004 Custom Integrated Circuits Conference, pp. 635-642.

*Primary Examiner* — Timothy J Dole
*Assistant Examiner* — Htet Z Kyaw
(74) *Attorney, Agent, or Firm* — Hauptman Ham, LLP

(57) ABSTRACT

A bandgap reference circuit including two sets of bipolar junction transistors (BJTs). A first set of two or more BJTs configured to electrically connect in a parallel arrangement. The first set of BJTs is configured to produce a first proportional to absolute temperature (PTAT) signal. A second set of two or more BJTs configured to electrically connect in a parallel arrangement. The second set of BJTs is configured to produce a second PTAT signal. A circuitry configured to electrically connect to the first set of BJTs and the second set of BJTs. The circuitry is configured to combine the first PTAT signal and the second PTAT signal to produce a reference voltage.

20 Claims, 7 Drawing Sheets

(56) References Cited

U.S. PATENT DOCUMENTS

| | | | | |
|---|---|---|---|---|
| 2009/0195301 | A1* | 8/2009 | Narayanan | G05F 3/30 327/539 |
| 2011/0121809 | A1* | 5/2011 | Galeano et al. | 323/313 |
| 2011/0215789 | A1* | 9/2011 | Bouwman | G05F 3/30 323/313 |
| 2015/0054487 | A1* | 2/2015 | Kochkin | G05F 3/16 323/314 |

* cited by examiner

BANDGAP REFERENCE CIRCUIT

BACKGROUND

Systems, e.g., power management systems such as mixed-signal and radio frequency systems, often use a reference voltage as a basis for comparison and calculation. The systems often include a thermal sensor circuit to monitor the temperature of devices within the systems. In some instances, power management systems include on-chip direct current (DC)-to-DC power converters that provide regulated DC power to other components, such as signal converters. Obtaining high resolution for high speed data conversions, such as analog-to-digital converters and digital-to-analog converters requires a highly accurate reference voltage. The accuracy of the reference voltage often determines a maximum achievable performance of an integrated circuit (IC). In some instances, the reference voltage is produced by a bandgap reference circuit. The reference voltage produced by the bandgap reference circuit does not significantly vary at low-voltage levels and has a low temperature dependency.

For the IC to function as intended, variations in the reference voltage are minimized. The IC includes several potential sources for introducing variations in the reference voltage including error currents associated with current mirrors, edge voltages associated with clamping circuits, and mismatches between transistors and resistors. Circuit designers attempt to minimize the impact from these and other sources of variations. However, the use of low supply voltages in small node, i.e., less than 28 nm, ICs limits the techniques available for circuit designers to adequately control variations in the reference voltage.

BRIEF DESCRIPTION OF DRAWINGS

One or more embodiments are illustrated by way of example, and not by limitation, in the figures of the accompanying drawings, wherein elements having the same reference numeral designations represent like elements throughout. It is emphasized that in accordance with the standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are of course, merely examples and are not intended to be limiting. For example, the formation of a first feature over or on a second feature in the description that follows includes embodiments in which the first and second features are formed in direct contact, and also includes embodiments in which additional features are formed between the first and second features.

Figure 1:
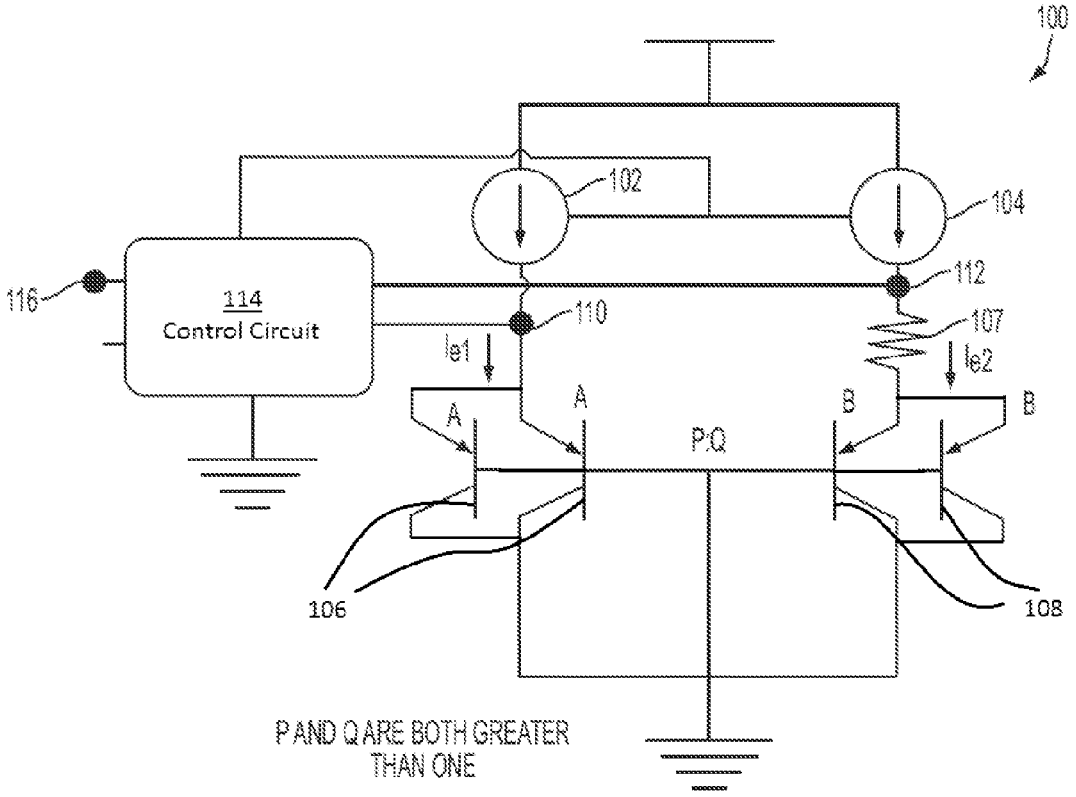
FIG. 1 is a schematic diagram of a proportional to absolute temperature (PTAT) circuit as a bandgap reference circuit in accordance with one or more embodiments.

FIG. 1 depicts a schematic diagram of a proportional to absolute temperature (PTAT) circuit 100 as a bandgap reference circuit, in accordance with one or more embodiments. PTAT circuit 100 includes a first current generator 102, a second current generator 104, a first set of bipolar junction transistors (BJTs) 106, a resistor 107, and a second set of BJTs 108. First current generator 102 is configured to generate a first supply current $I_{e1}$. Second current generator 104 is configured to generate a second supply current $I_{e2}$. The first set of bipolar junction transistors (BJTs) 106 is configured to receive first supply current $I_{e1}$. The second set of BJTs 108 is configured to receive second supply current $I_{e2}$, after second supply current $I_{e2}$ passes through the resistor 107. A control circuit 114 electrically connects to a node 110 between first current generator 102 and first set of BJTs 106 and a node 112 between second current generator 104 and second set of BJTs 108. Control circuit 114 supplies a feedback signal to control the first and second current generators 102 and 104 so that the voltage at nodes 110 and node 112 are equivalent. By controlling the first and second current generators 102 and 104 in such a manner, first supply current $I_{e1}$ will be equal to the second supply current $I_{e2}$. An output 116 electrically connects control circuit 114 to external devices.

When the voltage at nodes 110 and 112 are the same, and the supply currents Ie1 and Ie2 are same, a reference voltage signal is generated by PTAT circuit 100. A first proportional to absolute temperature (PTAT) signal is equal to a voltage drop, VBE1, across the first set of BJTs 106 and a second PTAT signal is equal to a voltage drop, VBE2, across the second set of BJTs 108. The reference voltage signal is equal to the difference of the first PTAT signal and the second PTAT signal. An output of PTAT circuit 100 will produce the reference voltage signal independent of variation in absolute temperature.

First set of BJTs 106 includes a number, P, of transistors A electrically connected in a parallel arrangement. In conventional bandgap reference circuits, the number of transistors in the first set of BJTs is equal to one. However, the number, P for some purpose, of transistors A in first set of BJTs 106 is greater than one. And that will be introduced later.

Second set of BJTs 108 includes a number, Q, of transistors B electrically connected in a parallel arrangement. The number, Q, of transistors B in second set of BJTs 108 is greater than one. In some embodiments, Q is greater than P. In some embodiments, Q is equal to P.

In some embodiments, transistors A and B are positive-negative-positive (PNP) BJTs. In some embodiments, transistors A and B are negative-positive-negative (NPN) BJTs. In some advance processes, for example 20 nm processes, a p-type device channel is doped SiGe to enhance carrier mobility. Hence, in some embodiments, a P+ doped portion of parasitic BJT will be replaced by SiGe material. A P+/NW junction is a homo-junction, however, a SiGe/NW junction changes to a hetero junction and modifies the ideality factor and linearity of BJT performance In some embodiments, an n-type channel comprises silicon carbide. In some embodiments, the silicon carbide and the silicon germanium are epitaxially grown.

When the bandgap reference circuit 100 is part of a semiconductor chip, the first PTAT signal is also used to monitor the temperature of the semiconductor chip. As the temperature of the semiconductor chip increases, the bandgap reference circuit 100 will generate the first PTAT signal $$PTAT=(n_f KT/q)*\ln(m)$$

where $n_f$ is the ideality factor, K is Boltzmann's constant, T is absolute temperature, q is one electronic charge ($1.6\times10^{-19}$ C) and m is the BJT ratio.

Figure 2A:
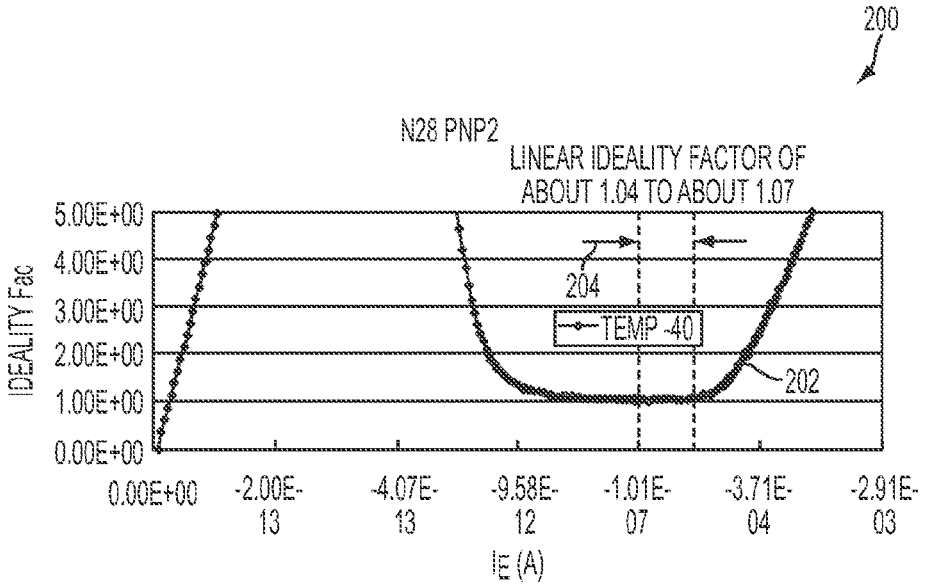
FIGS. 2A and 2B are graphs of an ideality factor of a transistor versus supply current to the transistor in according with one or more embodiments.

FIG. 2A depicts a graph 200 of an ideality factor of a transistor versus a supply current $I_e$ to the transistor at a temperature of −40° C. Curve 202 illustrates the ideality factor is substantially constant at a temperature of −40° C. for a supply current ranging from about 0.1 μA to about 100 μA. The substantially constant portion of curve 202 is called a constant ideality factor region 204. The ideality factor in constant ideality factor region 204 ranges from about 1.04 to about 1.07. Outside the constant ideality factor region 204 small fluctuations in supply current impacts the performance of the transistor. A bandgap reference circuit configured to operate outside constant ideality factor region 204 is more complex and costly to produce than bandgap reference circuit 100 configured to operate within constant ideality factor region 204.

Figure 2B:
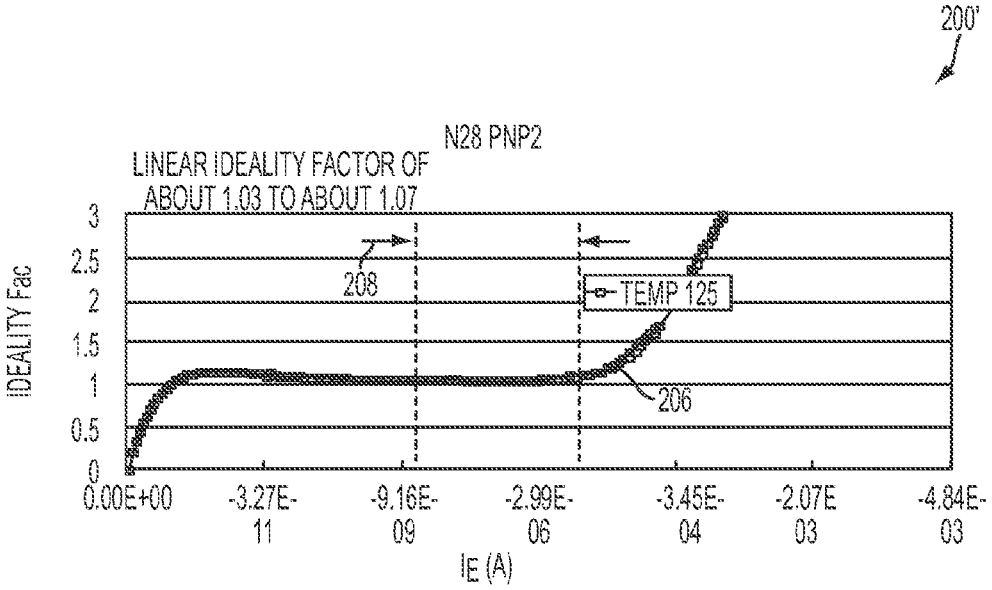

FIG. 2B depicts a graph 200' of an ideality factor of the transistor versus a supply current $I_e$ for the transistor at a temperature of 125° C. Curve 206 illustrates the ideality factor is substantially constant at a temperature of 125° C. for the supply current ranging from about 0.1 μA to about 100 μA. The substantially constant portion of curve 206 is a constant ideality factor region 208 for a temperature of 125° C. The ideality factor in constant ideality factor region 208 ranges from about 1.03 to about 1.07.

Figure 3:
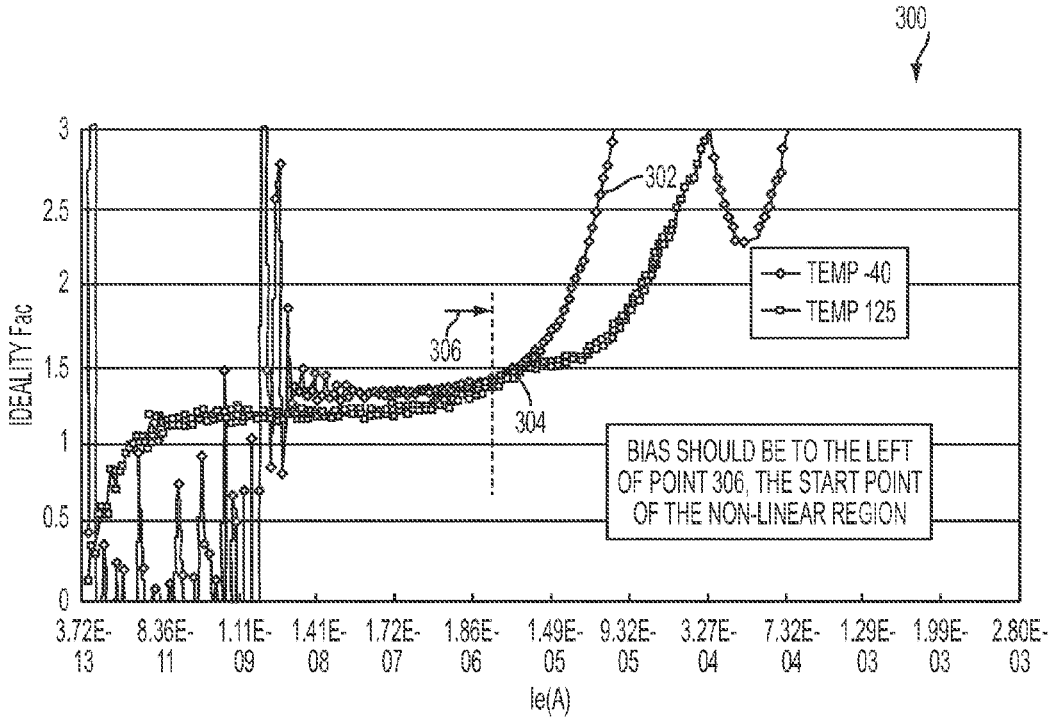
FIG. 3 is a graph of the ideality factor of a transistor versus the voltage drop across a base emitter junction of the transistor in accordance with one or more embodiments.

FIG. 3 depicts a graph 300 of the ideality factor of the SiGe doping transistor versus a voltage drop across an emitter ($V_{BE}$) of the transistor at temperatures of −40° C. and 125° C. Curve 302 represents the ideality factor of the transistor versus $V_{BE}$ at a temperature −40° C. Curve 304 represents the ideality factor of the transistor versus $V_{BE}$ at a temperature 125° C. Curves 302 and 304 illustrate a constant ideality factor region to the left of point 306. The constant ideality factor region for the graph of FIG. 3 is smaller than 4 μA. In order to operate in the constant ideality factor region, transistors in the bandgap reference circuit have a current bias less than or equal to 4 μA.

Figure 4:
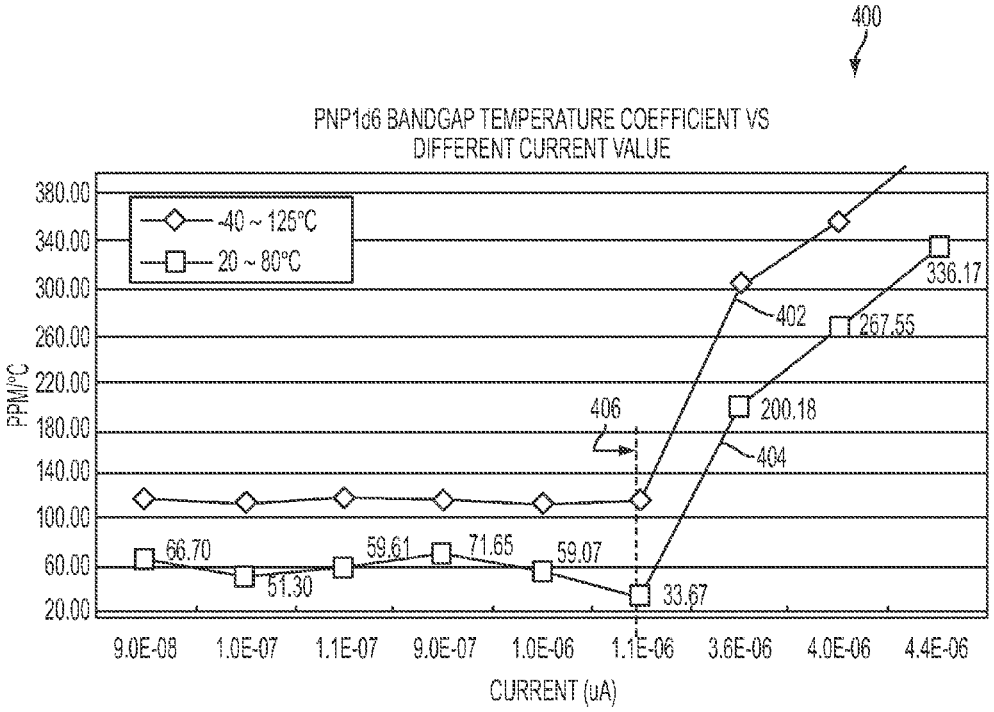
FIG. 4 is a graph of bandgap temperature coefficient for a bandgap reference circuit versus the supply current of the bandgap reference circuit for different temperature ranges in accordance with one or more embodiments.

FIG. 4 is a graph 400 of bandgap temperature coefficient for a bandgap reference circuit versus a supply current to a transistor for different temperature ranges in accordance with one or more embodiments. This bandgap reference circuit was implemented using a SiGe doped transistor (parasitic BJT). Curve 402 represents the temperature coefficient of bandgap reference output versus a supply current $I_e$ in a temperature range from −40° C. to 125° C. Curve 404 represents the temperature coefficient of bandgap reference output versus a supply current $I_e$ in a temperature range from 20° C. to 80° C. Within curves 402 and 404, the temperature coefficient of bandgap reference output remains substantially constant for supply currents to the left of point 406. Point 406 corresponds to a supply current $I_e$ of about 1.1 μA.

However, supply currents of about 1.1 uA cause mismatching between Ie1 and Ie2. In order to operate at a sufficiently large supply current, while maintaining a current in a range of substantially constant temperature coefficient, a number of BJTs is increased. The increased number of BJTs facilitates the use of supply currents to a group of BJTs within a range suitable to avoid mismatches between supply currents, while also reducing the current supplied to individual BJTs within the group.

Figure 5:
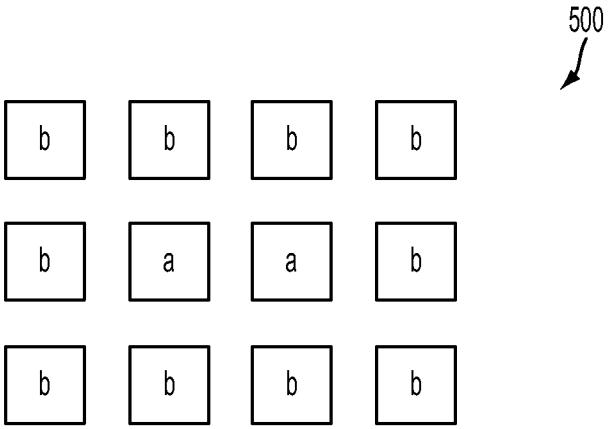
FIG. 5 is a layout of transistors A and B of FIG. 1 in a 3×4 array in accordance with one or more embodiments.

FIG. 5 is a layout 500 of transistors A and B of bandgap reference circuit 100 in a 3×4 array in accordance with one or more embodiments. In a centroid type pattern, the number, Q, of transistors B is determined by the equation Q=(n+2)×(m+2)−n×m, where n is a number of rows of transistors A, and m is a number of columns of transistor A, The transistors A of first set of BJTs 506 are located in two central locations surrounded by one layer of transistors B of second set of BJTs 508. For layout 500, P equals two (2) and Q equals ten (10). In a conventional bandgap reference circuit, the centroid pattern would include a single transistor A surrounded by a plurality of transistors B. The centroid type pattern including more than one transistor A tolerates an increase in supply current $Ie_1$, while maintaining a sufficiently low supply current to individual transistors.

Figure 6:
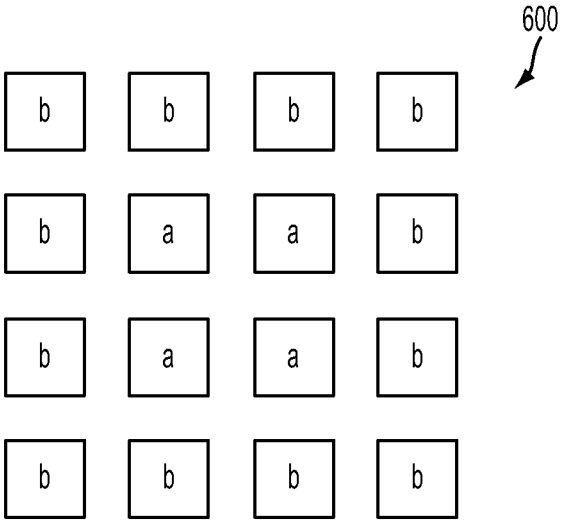
FIG. 6 is a layout of transistors A and B of FIG. 1 in a 4×4 array in accordance with one or more embodiments.

FIG. 6 is a layout 600 of transistors A and B of bandgap reference circuit 100 in a 4×4 array in accordance with one or more embodiments. The transistors A of first set of BJTs 106 are located in four central locations surrounded by one layer of transistors B of second set of BJTs 108. For layout 600, P equals four (4) and Q equals twelve (12).

Figure 7:
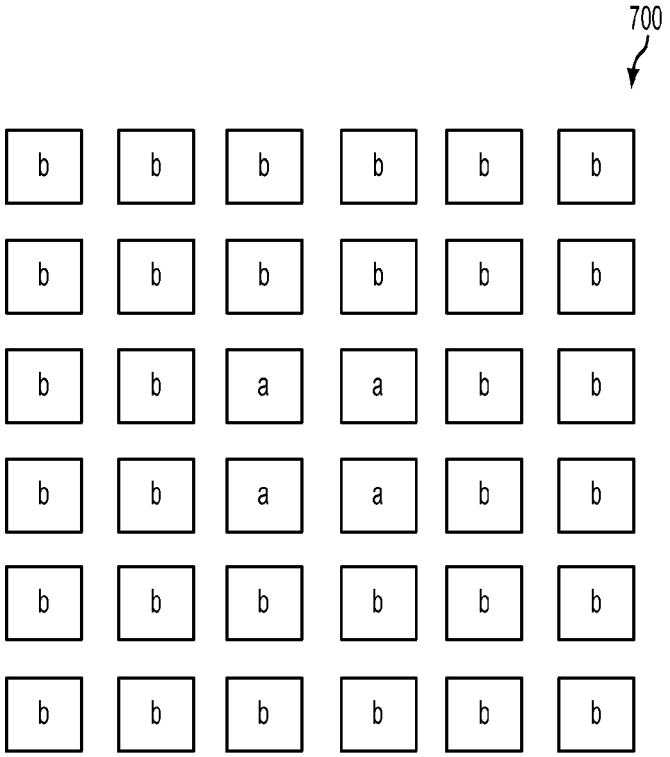
FIG. 7 is a layout of transistors A and B of FIG. 1 in a 6×6 array in accordance with one or more embodiments.

FIG. 7 is a layout 700 of transistors A and B of bandgap reference circuit 100 in a 6×6 array in accordance with one or more embodiments. The transistors A of the first set of BJTs 106 are located in four central locations surrounded by two layers of transistors B of the second set of BJTs 108. Because the transistors A are surrounded by more than one layer of transistors B layer, in a centroid type pattern, the number, Q, of transistors B is determined by the equation Q=(n+E)×(m+E)−n×m, where n is a number of rows of transistors A, m is a number of columns of transistor A, and E is an even integer equal to or greater than two. The value of E is the number of transistors B separating any transistor A from an exterior of a centroid type pattern layout. Continuing with the above example and an E value selected as two, the ratio of transistors A to transistors B is 4 to 32.

Figure 8A:
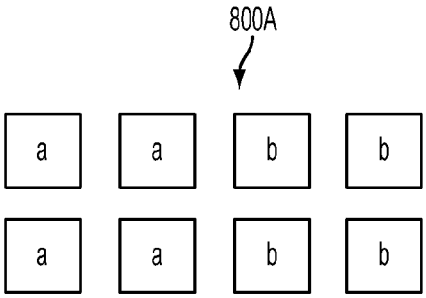
FIGS. 8A and 8B are layouts of transistors A and B of FIG. 1 where the ratio of transistors A:B is 1:1 in accordance with one or more embodiments.
Figure 8B:
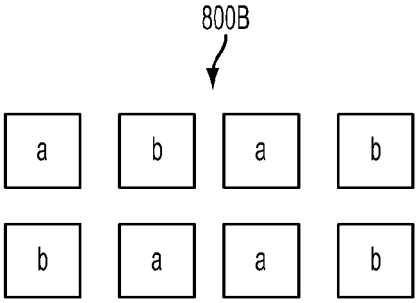

FIGS. 8A and 8B are layouts of transistors A and B of bandgap reference circuit 100 where the ratio of transistors A:B is 1:1. Supply current $I_{e1}$ to transistor A and supply current $I_{e2}$ to transistor B will have ratio relationship to generate a PTAT signal for temperature sensor applications. Supply currents $I_{e1}$ and $I_{e2}$ for bandgap reference circuits 100 having a matching layout is higher than for bandgap reference circuits 100 having a centroid-type layout. However, in order to maintain the individual transistors operating in a current range having a linear ideality factor the number of transistors A and B are increased as well.

FIG. 8A depicts a matching pattern having a 2×2 array of transistors A beside a 2×2 array of transistors B to form a 2×4 array. FIG. 8B depicts a matching pattern in a 2×4 array with transistors A and transistors B arranged in an alternating fashion. In some embodiments, transistors A and transistors B are arranged in different arrangements having a ratio of transistors A to transistors B of 1:1.

Figure 9:
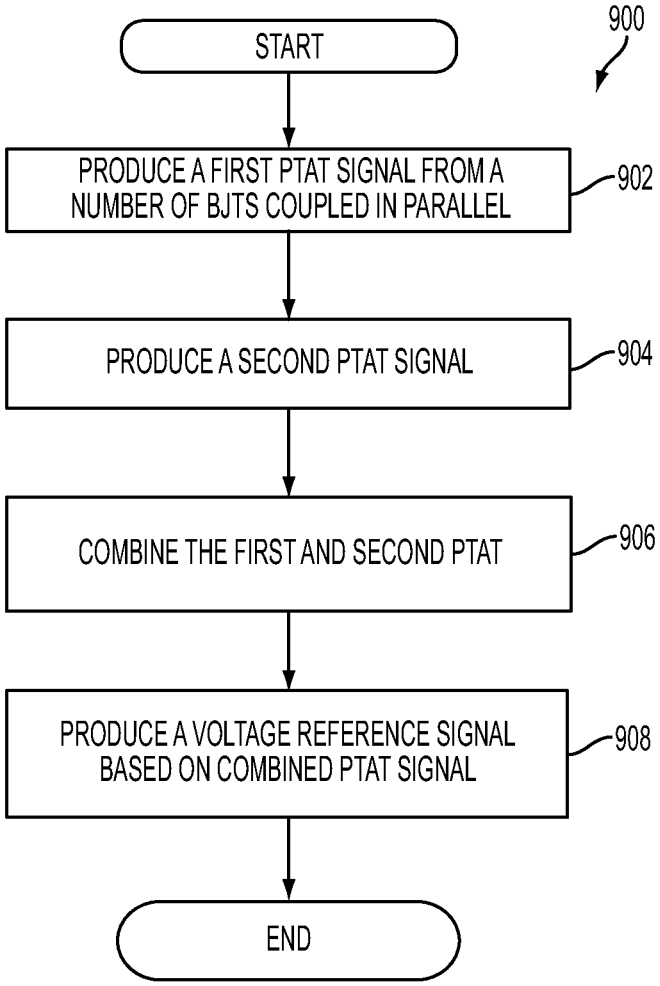
FIG. 9 is a logic flow diagram associated with a method of generating a reference voltage by a bandgap reference circuit in accordance with one or more embodiments.

FIG. 9 is a logic flow diagram associated with a method 900 of generating a reference voltage by a bandgap reference circuit.

In step 902, a first PTAT signal is produced by a first set of BJTs configured to electrically connect in a parallel arrangement. Lower supply currents reduce ideality factor fluctuations based on temperature changes of the BJT. Also as depicted in graphs 200 and 200', a BJT having a supply current in a range from about 0.1 μA to about 20 μA functions in a linear ideality factor region.

In block 904, a second PTAT signal is produced by a second set of BJTs. The second set of BJTs is configured to electrically connect in a parallel arrangement, similar to the first set of BJTs.

In block 906, a circuitry combines the first PTAT signal and second PTAT signal to produce a reference voltage. In some embodiments, circuitry 114 is configured to produce the reference voltage by adding the first PTAT signal combined with suitable multiplication constants and the second PTAT signal combined with suitable multiplication constants. Because the first PTAT signal and the second PTAT signal have temperature coefficients of opposite signs, the resulting reference voltage is independent of temperature.

One aspect of this description relates to a bandgap reference circuit, including a first set of two or more bipolar junction transistors (BJTs) configured to electrically connect in a parallel arrangement, where the first set of BJTs is configured to produce a first proportional to absolute temperature (PTAT) signal; a second set of two or more BJTs configured to electrically connect in a parallel arrangement, where the second set of BJTs is configured to produce a second PTAT signal; and a circuitry configured to electrically connect to the first set of BJTs and the second set of BJTs, wherein the circuitry is configured to combine the first PTAT signal and the second PTAT signal to produce a reference voltage.

Another aspect of this description relates to a bandgap reference circuit configured to provide a reference voltage, the bandgap reference circuit including a first set of bipolar junction transistors (BJTs) configured to electrically connect in a parallel arrangement, where the first set of BJTs comprises a number P of BJTs, the first set of BJTs is configured to produce a first proportional to absolute temperature (PTAT) signal, and P is greater than one; a second set of BJTs configured to electrically connect in a parallel arrangement, where the second set of BJTs comprises a number Q of BJTs, the second set of BJTS is configured to produce a second PTAT signal, and Q is greater than one; and a circuitry configured to electrically connect to the first set of BJTs and the second set of BJTs, where the circuitry is configured to combine the first PTAT signal and the second PTAT signal to produce a reference voltage.

Still another aspect of this description relates to a method of producing a reference voltage including producing a first proportional to absolute temperature signal (PTAT) using a first set of two or more bipolar junction transistors (BJTs) configured to electrically connect in a parallel arrangement; producing a second PTAT using a second set of two or more BJTs configured to electrically connect in a parallel arrangement; and producing the reference voltage using a circuitry to combine the first PTAT and the second PTAT, wherein the circuitry is configured to electrically connect to the first set of BJTs and the second set of BJTs.

While the description is presented by way of examples and in terms of specific embodiments, it is to be understood that the invention is not limited to the disclosed embodiments. To the contrary, it is intended to cover various modifications and similar arrangements (as would be apparent to those skilled in the art). The above description discloses exemplary steps, but they are not necessarily required to be performed in the order described. Steps can be added, replaced, change in order, and/or eliminated as appropriate, in accordance with the spirit and scope of the description. Embodiments that combine different claims and/or different embodiments are within the scope of the description and will be apparent to those skilled in the art after reviewing this disclosure. Therefore, the scope of the appended claims should be accorded the broadest interpretation so as to encompass all such modifications and similar arrangements.

What is claimed is:

1. A bandgap reference circuit, comprising:

a first set of two or more bipolar junction transistors (BJTs) configured to electrically connect in a parallel arrangement, wherein the first set of BJTs is configured to produce a first proportional to absolute temperature (PTAT) signal; and a second set of two or more BJTs configured to electrically connect in a parallel arrangement, wherein the second set of BJTs is configured to produce a second PTAT signal, wherein the first set and the second set of BJTS are collectively arranged in a centroid type pattern, and a number of BJTs in the second set is defined by $Q=(n+E)\times(m+E)-n\times m$, where Q is the number of BJTs in the second set, n is a number of rows of BJTs in the first set, m is a number of columns of BJTs in the first set, and E is an even integer.

2. The bandgap reference circuit of claim 1, further comprising:

a circuitry configured to electrically connect to the first set of BJTs and the second set of BJTs, wherein the circuitry is configured to combine the first PTAT signal and the second PTAT signal to produce a reference voltage.

3. The bandgap reference circuit of claim 2, wherein the circuitry is configured to subtract the second PTAT signal from the first PTAT signal.

4. The bandgap reference circuit of claim 1, wherein the first set of BJTs comprises epitaxial (EPI) BJTs comprising silicon germanium and/or silicon carbide.

5. The bandgap reference circuit of claim 4, wherein an epitaxial layer of the EPI BJTs are configured to form a hetero-junction.

6. The bandgap reference circuit of claim 1, wherein the bandgap reference circuit is configured to so each BJT in the first set of BJTs has an ideality factor ranging from about 1.04 to about 1.07.

7. The bandgap reference circuit of claim 1, wherein the first set of BJTs comprises n-type metal oxide semiconductor BJTs.

8. A bandgap reference circuit configured to provide a reference voltage, the bandgap reference circuit comprising:

a first set of bipolar junction transistors (BJTs) configured to electrically connect in a parallel arrangement, wherein the first set of BJTs comprises a number P of BJTs, the first set of BJTs is configured to produce a first proportional to absolute temperature (PTAT) signal, and P is greater than one; and a second set of BJTs configured to electrically connect in a parallel arrangement, wherein the second set of BJTs comprises a number Q of BJTs, the second set of BJTS is configured to produce a second PTAT signal, and Q is greater than one, wherein the first set of BJTs comprises a number P of BJTs equal to a number Q of BJTs in the second set, the first set of BJTs and the second set of BJTs are collectively arranged in a matching pattern, and a first base terminal of the first set of BJTs is coupled to a second base terminal of the second set of BJTs.

9. The band gap reference circuit of claim 8, further comprising:

a circuitry configured to electrically connect to the first set of BJTs and the second set of BJTs, wherein the circuitry is configured to combine the first PTAT signal and the second PTAT signal to produce a reference voltage.

10. The bandgap reference circuit of claim 9, wherein the circuitry is configured to subtract the second PTAT signal from the first PTAT signal.

11. The bandgap reference circuit of claim 8, wherein the first set of BJTs comprises epitaxial (EPI) BJTs.

12. The bandgap reference circuit of claim 8, wherein an epitaxial layer of the EPI BJTs comprises silicon germanium and/or silicon carbide and is configured to form a hetero-junction.

13. The bandgap reference circuit of claim 8, wherein the bandgap reference circuit is configured to so each BJT in the first set of BJTs has an ideality factor ranging from about 1.04 to about 1.07.

14. A method of producing a reference voltage, comprising:

producing a first proportional to absolute temperature signal (PTAT) using a first set of two or more bipolar junction transistors (BJTs) doped with silicon germanium to form a hetero-junction configured to electrically connect in a parallel arrangement;

producing a second PTAT using a second set of two or more BJTs configured to electrically connect in a parallel arrangement; and producing the reference voltage using a circuitry to combine the first PTAT and the second PTAT, wherein the circuitry is configured to electrically connect to the first set of BJTs and the second set of BJTs, and a first base terminal of the first set of two or more BJTs is coupled to a second base terminal of the second set of two or more BJTs.

15. The method of claim 14, wherein the producing the first PTAT comprises using the first set of BJTs comprising a number P of BJTs; and the producing the second PTAT comprises using the second set of BJTs comprising a number Q of BJTs, wherein Q is equal to P, and the first set of BJTs and the second set of BJTs are arranged in a matching pattern.

16. The method of claim 14, wherein the producing the first PTAT comprises using the first set of BJTs comprising a number P of BJTs; and the producing the second PTAT comprises using the second set of BJTs comprising a number Q of BJTs, wherein Q is greater than P, and the first set of BJTs and the second set of BJTs are arranged in a centroid type pattern.

17. The method of claim 16, wherein the number of BJTs in the second set is defined by $Q=(n+E)\times(m+E)-n\times m$, where n is a number of rows of BJTs in the first set, m is a number of columns of BJTs in the first set, and E is an even integer.

18. The method of claim 14, wherein producing the reference voltage comprises subtracting the second PTAT signal from the first PTAT signal.

19. The method of claim 14, wherein producing the first PTAT comprises supplying a current to the first set of BJTs such that each BJT of the first set of BJTs has an ideality factor ranging from about 1.04 to about 1.07.

20. The method of claim 14, wherein the producing the first PTAT using the first set of BJTs comprises using epitaxial (EPI) BJTs.

* * * * *